US005291101A

United States Patent [19]

Chandrasekaran

[11] Patent Number: 5,291,101

[45] Date of Patent: Mar. 1, 1994

[54] ELECTRONIC BALLAST FOR A DISCHARGE LAMP WITH CURRENT SENSING

[75] Inventor: T. Chandrasekaran, Bangalore, India

[73] Assignee: Micro Technology, Inc., Menomonee Falls, Wis.

[21] Appl. No.: 920,670

[22] Filed: Jul. 28, 1992

[51] Int. Cl.[5] ..... H05B 37/02

[52] U.S. Cl. ..... 315/219; 315/219; 315/208; 315/DIG. 5; 315/DIG. 7

[58] Field of Search ..... 315/219, 208, DIG. 5, 315/DIG. 7; 363/331

[56] References Cited

U.S. PATENT DOCUMENTS

| | | | |
|---|---|---|---|
| 4,175,246 | 11/1979 | Feinberg et al. | 315/101 |
| 4,472,661 | 9/1984 | Culver | 315/206 X |
| 4,553,070 | 11/1985 | Sairanen et al. | 315/209 R |
| 4,722,040 | 1/1988 | Ball | 315/DIG. 7 X |
| 5,034,660 | 7/1991 | Sairanen | 315/174 |
| 5,045,760 | 9/1991 | Teresinki | 315/219 X |
| 5,063,331 | 11/1991 | Nostwick | 315/209 R X |

*Primary Examiner*—Robert J. Pascal
*Assistant Examiner*—R. A. Ratliff
*Attorney, Agent, or Firm*—Robert J. Black

[57] ABSTRACT

An electronic ballast for use with a fluorescent lamp. A pair of oppositely poled diodes connected in parallel with a transformer used to drive the switching transistors of an inverter in the ballast, ensuring operation of the transistors at zero current crossing.

7 Claims, 1 Drawing Sheet

TO VOLTAGE SOURCE

TO VOLTAGE SOURCE

ELECTRONIC BALLAST FOR A DISCHARGE LAMP WITH CURRENT SENSING

BACKGROUND OF THE INVENTION

1. Field of the Invention

The present invention relates to fluorescent lamps and more particularly to an electronic ballast for use with such fluorescent lamps.

2. Background Art

Fluorescent lamps usually require a ballast circuit for producing an alternate current signal with a high voltage amplitude for effective operation of the fluorescent lamp. Ballasts of this type are typically separated into two broad categories, the first being of the electromagnetic type while the second is of a true electronic form.

The ballast is a device which performs the following functions:

(a) apply a high voltage across the lamp, in order to fire an arc in the lamp, and (b) limit the current through the lamp, once the arc has been fired.

In the electronic ballast, a resonant element is used to provide the initial starting voltage to the lamp and also to limit the current through the lamp, once the arc has been struck.

A background art search directed to the subject matter of this application and conducted in the U.S. Patent and Trademark Office disclosed the following U.S. Pat. Nos. 4,175,246, 4,472,661, 4,553,070, 4,722,040, 5,034,660, 5,063,331.

None of the patents uncovered in the search disclosed means converting current into voltage or an included transformer therein, where depending upon direction of current, either positive or negative voltage applied across the transformer and hence associated switching elements where switch over occurs at zero current crossing.

In most self-commutating series resonating circuits, such as found in the prior art, the transformer included serves as the commutating element. It has been discovered that the transformer typically has two modes of operation. In such an arrangement, the transformer senses the zero-crossing of its primary current and hence causes the polarity of the secondary voltages to change. This then causes the associated switching transistors to switch over when current through them is zero, thus minimizing stress on the transistors.

The transformer also senses a decrease in its primary current and hence causes the polarity of the secondary voltages to change. This causes the transistor to switch over when the current through them is at maximum value. This operation then greatly increases the losses in the transistor and also increases stress on them.

While operation in the first mode is considered desirable, the actual mode of operation of the transformer is a function of the primary current depending thus on the construction of the transformer, etc. In fact, both modes of operation have been observed in the same circuit at different intervals of time.

SUMMARY OF THE INVENTION

The present invention includes a pair of opposite polarized diodes across the transformer, which force the transformer into operation in the first of the modes described above, thus decreasing power loss in the transistor as well as reducing stress on them and hence increasing reliability of the ballast circuitry.

The inclusion of the diodes across the transformer also enables the use of Metallic Oxide Silicon Field Effect Transistors (MOSFETS) as the switching elements in the inverter, since the voltage across transformer secondaries can be accurately controlled.

The lamp is connected across the capacitor of the resonating element, ensuring that the lamp filaments are heated before the arc is struck, thus ensuring long lamp life start up time.

As described above, the innovative use of diodes across the drive transformer appears to reduce the complexity of circuit operation making it easier to determine and control the ballast operation. The result is a reduction in material costs along with increased reliability of the ballast.

BRIEF DESCRIPTION OF THE DRAWINGS

A better understanding of the present invention may be had from a consideration of the following detailed description taken in conjunction with the accompanying drawings in which.

DESCRIPTION OF THE PREFERRED EMBODIMENT

Figure 1:
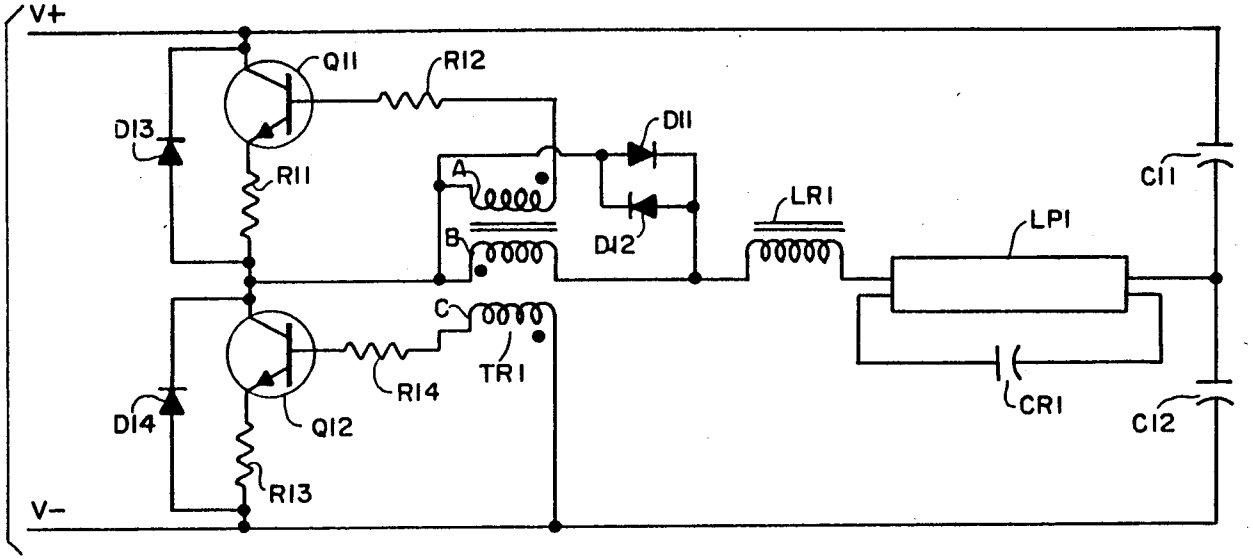
FIG. 1 is a schematic diagram of an electronic ballast circuit for use with fluorescent lamps, employing bipolar transistors as the switching elements in accordance with the present invention.
Figure 2:
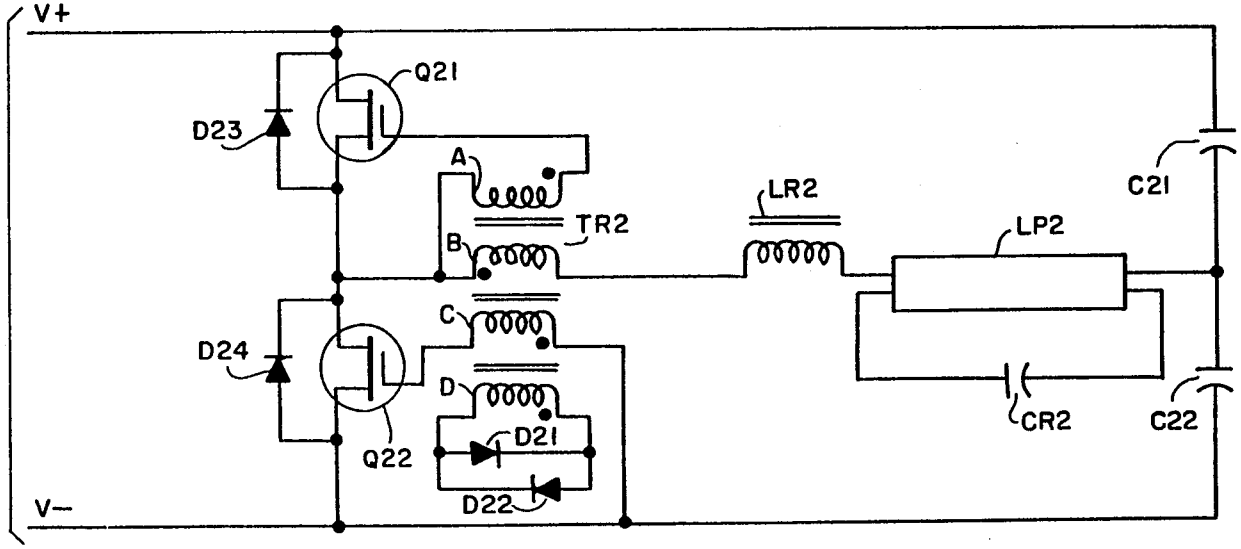
FIG. 2 is a schematic diagram of an electronic ballast circuit for use with fluorescent lamps, employing MOSFETS in accordance with another embodiment of the present invention.

Referring now to drawings of the present invention, it should be noted in both FIGS. 1 and 2 a positive and negative voltage bus are derived from a voltage source which consists of a bridge rectifier. In practical embodiments of the present invention the rectifier is connected to an AC power source. It is by means of such bridge rectifiers that the AC input voltage normally derived from the AC line is rectified and the resultant direct current filtered using capacitors connected in a "valley-fill" configuration. The use of this configuration causes current to be drawn for a longer period during each AC cycle thus increasing the power factor of the ballast and also reducing harmonic distortion to the input line current.

It has also been found convenient to include a fuse in series with the alternating current supply as well as a metallic oxide varistor across the AC supply to protect against surge voltages that may be present in the alternating current line. It should be noted that the particular details of the bridge circuitry are well known in the prior art, and thus accordingly do not form a part of the present invention and thus have not been shown in detail.

Referring now to FIG. 1, the basic resonating element consists of an inductor LR1 and a capacitor CR1 connected in series. Power is fed into the resonating element to a half bridge inverter circuit consisting of transistors Q11 and Q12 and associated circuitry transformer TR1.

It has been found that electronic ballasts employing series resonance technology are ideally more reliable and cost effective compared to that found in other technology. However, typical series resonant based ballast schematics operate at a frequency determined by values of inductor LR1 and capacitor CR1. Accordingly, transistors Q11 and A12 will then switch over when the current becomes zero. In the usual arrangement, the transformer sends current towards inductor LR1. When the current is positive, transistor Q11 turns on, and during negative current, transistor Q12 operates. As a practical matter, the self-inductance of transformer TR1 may dominate and transistor switch over occurs when the current reaches the maximum and starts to descend. At this point, the transistors get the maximum current. Instead of improving the reliability, the series resonant ballast may reduce reliability.

Accordingly, in the present circuitry, the provision of diodes D11 and D12 across the primary winding B of transformer TR1 conduct current from transistors Q11 and Q12 to inductor LR1 in both directions. The diodes D11 and D12 convert current into voltage for transformer TR1. Depending upon the direction of current, either positive or negative voltage is applied across the transformer TR1. Thus, the switch over from transistor Q11 to Q12 occurs at zero current crossing. With this arrangement the questionable operation of the typical series resonant ballast is eliminated. Thus, as the current zero crossing ensures the switch over, the ballast inherently becomes much more reliable. It has been found that the inclusion of the diodes, such as D11 and D12 across the transformer TR1, forces the transformer into operation in the zero crossing mode, thus decreasing power loss in the transistor, reducing stresses on them and increasing reliability of the ballast.

The inclusion of the diodes in the present circuitry also enables the use of MOSFETS as the switching element shown as Q21 and Q22 in FIG. 2. Here, diodes D21 and D22 perform a similar function since the voltage across the secondaries of transformer TR2 can be controlled accurately. Circuitry is similar to that shown in FIG. 1, except that the transistors D21 and D22 are across an additional secondary D on transformer TR2.

It has been found that when we replace the bipolar transistors Q11 and Q12 of FIG. 1 by field effect transistors Q21 and Q22 as seen in FIG. 2, the high input impedance and the input capacitance pose a slightly different type of problem. As shown in the circuit of FIG. 2, an additional problem occurs, in addition to the oscillation by the inductor LR2 and capacitor CR2. Another oscillation occurs herein due to the self-inductance within transformer TR2 and the input capacitance of the power MOSFETS. This distorts the current waveform in the circuit. The solution is for the inductance of transformer TR to be in parallel with another impedance so that such unwanted oscillation can be avoided. As may be seen in FIG. 2, diodes D21 and D22 are in parallel to the additional secondary D of transformer TR2. Now the diodes are in parallel with the self-inductance of transformer TR2. Thus, this non-linear load acts to avert the oscillation that would normally be found in this type of circuit. Thus, utilization of power MOSFETS within the electronic ballast becomes feasible.

From the foregoing it will be obvious that as described above the innovative use of diodes across the drive transformers makes it much easier to determine and control the operation of the electronic ballast. The arrangement results in lower material costs and substantially increased reliability of the ballast.

While but only a pair of embodiments of the present invention has been shown, it will be obvious to those skilled in the art that numerous modifications may be made without departing from the spirit of the present invention which shall be limited only by the scope of the claims appended hereto.

What is claimed is:

1. A ballast circuit for a fluorescent lamp comprising:
said inverter circuit connected to a source of direct current;
an inverter circuit including first and second switching transistors;
a transformer including a primary winding, first and second secondary windings;
said first secondary winding, 180 degrees out of phase with said second secondary winding;
said first and second secondary windings each including a circuit connection to said first and second switching transistors respectively;
a resonant element connected between said lamp and said inverter circuit;
a pair of oppositely poled diodes connected in parallel;
a pair of diodes connected in parallel with said transformer;
said diodes operated to convert current into voltage for said transformer, causing positive, or in the alternative negative voltage to be applied across said transformer causing said transformer to detect a zero crossing of current in said primary winding;
said zero crossing of current sensing in said primary winding operated to cause voltages in said secondaries to change, said current in said transistors is zero, whereby stresses on said switching transistors are minimized.

2. A ballast circuit as claimed in claim 1 wherein:
said diodes are connected in parallel with said primary winding of said transformer.

3. A ballast circuit as claimed in claim 1 wherein:
there is further included a third secondary winding included in said transformer;
and said diode pair is connected in parallel with said third secondary winding.

4. A ballast circuit as claimed in claim 1 wherein:
said resonant element consists of an inducter and a capacitor connected in series.

5. A ballast circuit as claimed in claim 1 wherein:
said switching transistors are each of the bipolar type.

6. A ballast circuit as claimed in claim 1 wherein:
said switching transistors each comprise a metallic oxide silicon field effect transistor.

7. A ballast circuit as claimed in claim 1 wherein:
said first and second secondary windings are 180 degrees out of phase with each other said windings providing gate drive for said switching transistors, whereby said transistors are operated in a "push-pull" mode.

* * * * *